US005568819A

United States Patent [19]

Gentry et al.

[11] Patent Number: 5,568,819

[45] Date of Patent: Oct. 29, 1996

[54] CIGARETTE FILTER

[75] Inventors: Jeffery S. Gentry, Pfafftown; Karen M. Womble, Winston-Salem; Chandra K. Banerjee; Richard L. Blakley, both of Pfafftown; Russell D. Barnes, Belews Creek; Donald A. Calleson, Winston-Salem; Henry T. Ridings, Lewisville, all of N.C.

[73] Assignee: R. J. Reynolds Tobacco Company, Winston-Salem, N.C.

[21] Appl. No.: 264,217

[22] Filed: Jun. 22, 1994

Related U.S. Application Data

[63] Continuation-in-part of Ser. No. 76,711, Jun. 11, 1993, Pat. No. 5,404,890.

[51] Int. Cl.[6] ..... A24D 3/00; A24D 1/02

[52] U.S. Cl. ..... 131/342; 131/361; 131/365; 131/344; 131/331; 131/339

[58] Field of Search ..... 131/342, 361, 131/365, 344, 331, 339

[56] References Cited

U.S. PATENT DOCUMENTS

| | | | |
|---|---|---|---|
| 3,894,545 | 7/1975 | Crellin et al. | 131/339 |
| 4,807,809 | 2/1989 | Pryor et al. | 131/342 |
| 5,404,890 | 4/1995 | Gentry et al. | 131/342 |

*Primary Examiner*—Nathan M. Nutter
*Assistant Examiner*—Duc Truong

[57] ABSTRACT

A cigarette includes a filter element including a carbon-containing paper or a paper containing molecular sieves. The paper contacts the filter material, such as cellulose acetate tow, within the filter element, either by circumscribing the filter material or by being gathered with non-carbon-containing filter material. The paper is useful as a plug wrap for a filter element. In several embodiments, longitudinal grooves are provided on the periphery of the filter element.

19 Claims, 3 Drawing Sheets

CIGARETTE FILTER

CONTINUING APPLICATION INFORMATION

This application is a continuation-in-part of U.S. patent application Ser. No. 08/076,711 filed Jun. 11, 1993, now U.S. Pat. No. 5,404,890.

BACKGROUND OF THE INVENTION

The present invention relates to smoking articles such as cigarettes, and in particular, to cigarettes having filter elements containing a carbonaceous material.

Popular smoking articles, such as cigarettes, have a substantially cylindrical rod shaped structure and include a charge of smokable material such as shredded tobacco (e.g., in cut filler form) surrounded by a paper wrapper thereby forming a so-called "tobacco rod." Normally, a cigarette has a cylindrical filter element aligned in an end-to-end relationship with the tobacco rod. Typically, a filter element includes cellulose acetate tow circumscribed by plug wrap, and is attached to the tobacco rod using a circumscribing tipping material. It also has become desirable to perforate the tipping material and plug wrap, in order to provide dilution of drawn mainstream smoke with ambient air.

Cigarettes are employed by the smoker by lighting one end thereof and burning the tobacco rod. The smoker then receives mainstream smoke into his/her mouth by drawing on the opposite end (e.g., the filter end) of the cigarette.

Certain cigarettes have filter elements which incorporate materials such as carbon. Exemplary cigarettes and filters therefore are described in U.S. Pat. Nos. 2,881,770 to Tovey; 3,353,543 to Sproull et al.; 3,101,723 to Seligman et al.; and 4,481,958 to Ranier et al. and European Patent Application No. 532,329. Certain commercially available filters have particles or granules of carbon (e.g., an activated carbon material or an activated charcoal material) dispersed within cellulose acetate tow; other commercially available filters have carbon threads dispersed therein; while still other commercially available filters have so-called "cavity filter" or "triple filter" designs. Exemplary commercially available filters are available as SCS IV Dual Solid Charcoal Filter from American Filtrona Corp.; Triple Solid Charcoal Filter from FIL International, Ltd.; Triple Cavity Filter from Baumgartner; and ACT from FIL International, Ltd. See, also, Clarke et al., *World Tobacco*, p. 55 (Nov., 1992).

Cigarette filter elements which incorporate carbon have the ability to change the character of mainstream smoke which passes therethrough. For example, such filter elements have the propensity to reduce the levels of certain gas phase components present in the mainstream smoke, resulting in a change in the organoleptic properties of that smoke.

However, such filter elements often incorporate relatively high levels of carbon (e.g., in particulate form), and/or are longitudinally segmented in format and configuration. As such, filter elements incorporating carbon require numerous and labor intensive processing steps; and cigarettes incorporating such filter elements often can be characterized as having slightly metallic drying and powdery flavor characteristics.

It would be desirable to provide a cigarette having a cigarette element incorporating carbon or other material capable of absorbing and/or adsorbing gas phase components present in mainstream cigarette smoke, which filter element can be manufactured in an efficient and effective manner.

SUMMARY OF THE INVENTION

The present invention relates to cigarettes having a charge or roll of smokable material contained in a circumscribing wrapping material to form a so-called "smokable rod" or "tobacco rod". The smokable material is a smokable filler material comprising tobacco cut filler material. Normally, the smokable material is all tobacco cut filler material, and preferably that cut filler material has been cased and/or top dressed. The wrapping material is a paper wrapping material.

Cigarettes of the present invention each include a filter element which acts as a mouthpiece. The filter element includes a filter material (e.g., cellulose acetate tow), and a carbonaceous material or other material capable of absorbing and/or adsorbing gas phase components present in mainstream cigarette smoke.

In a first preferred embodiment, the filter element includes one longitudinally extending segment, as opposed to a filter element having two or more longitudinally positioned filter segments. However, in a second embodiment, the filter element can be concentric in nature, and as such, have a plurality of segments each of which extend along the total length of that filter element. The carbonaceous material (e.g., an activated carbon material or an activated charcoal material in a powdered or fine grain form) is incorporated into the filter element as a component of a paper (e.g., the paper includes a carbonaceous material as a component thereof). Alternatively, the carbonaceous material within the paper can be replaced by another material capable of absorbing and/or adsorbing gas phase components from smoke passing through the filter element. Such other material can be in the form of alumina granules, microsponge particles, molecular sieve particles (e.g., zeolite granules), and the like. Typically, the paper which incorporates the carbonaceous material is incorporated into the filter element in a configuration resembling a tube which extends from one end of the filter element to the other. For example, the paper incorporating the carbonaceous material can (i) act as a plug wrap material for a filter material, and/or (ii) act as a circumscribing wrap for an inner or core of filter material which is in turn circumscribed by an outer or sheath of filter material.

In a third embodiment, the filter element includes two or more longitudinally positioned segments. As such, the segments can be combined in a variety of arrangements, depending upon the properties of the components of the individual segments and the desired characteristics of the filter element. At least one segment of such a filter element includes the paper incorporating the carbonaceous material, which paper (i) acts as a plug wrap material for the filter material of that segment, and/or (ii) acts as a circumscribing wrap for an inner region or core of filter material which is in turn circumscribed by an outer or sheath of filter material.

The tobacco rod and filter element are secured together using a tipping material. The resulting cigarette optionally can be air diluted (e.g., by perforating the tipping material in the regions which overlies the filter elements or by other such air dilution means). When air diluted, the filter element normally is ventilated to provide a cigarette having an air dilution between about 25 and about 75 percent. As used herein, the term "air dilution" is the ratio (expressed as a percentage) of the volume of air drawn through the air dilution means to the total volume of air and smoke drawn through the cigarette and exiting the extreme mouthend portion of the cigarette. See, Selke, et al., *Beitr. Zur Tabak. In.*, Vol. 4, p. 193 (1978).

In a fourth embodiment, a filter element preferably of highly impervious cellulose acetate tow is provided having a plurality of longitudinally extending grooves on the outer periphery of the filter element. The grooves extend substantially along the length of the filter element, but terminate before the mouthpiece end of the filter element. In fourth, fifth and sixth embodiments, one or more layers of a carbonaceous material, such as a carbon-containing paper, are wrapped about the filter element. The grooves and the carbon-containing paper form a channel through which mainstream smoke is drawn and with which the smoke interacts, thereby absorbing and/or adsorbing gas phase components of the smoke, before the smoke passes back through the region of the filter element near the mouthpiece end. In a seventh embodiment, the grooves extend along the entire length of the filter. Instead of using grooves to form channels for the smoke, an embossed pattern can be provided on the outer surface of the filter element, which is overwrapped by carbon-containing paper. As in the previously described embodiments, the filter element and tobacco rod are secured together using a tipping material. Air ventilation can be provided by making a hole in each channel.

In an eighth embodiment, a web of filter material such as cellulose acetate tow or other suitable material free of carbon particles is gathered simultaneously with a carbon-containing paper to form a filter segment having essentially randomly arranged flow channels formed by the carbon-containing paper and filled with a porous web through which cigarette smoke passes, with the smoke interacting with the carbon-containing paper, so as to absorb and/or adsorb gas phase components of the smoke. As in the previous embodiments, the filter segment is overwrapped by a layer of plug wrap. A mouthpiece end is provided of cellulose acetate tow or other suitable filter material and having ventilation holes formed therein near the junction with the carbon-containing segment. The entire filter is joined to a rod of smokable material by tipping material.

DETAILED DESCRIPTION OF THE PREFERRED EMBODIMENTS

Figure 1:
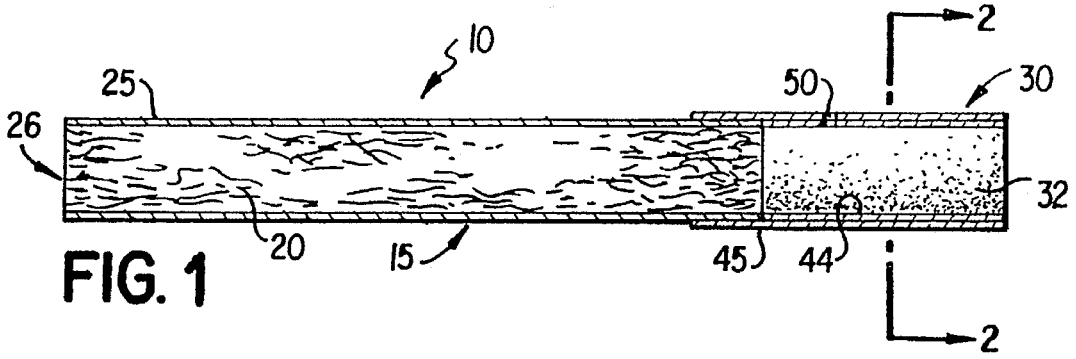
FIG. 1 is a longitudinal sectional view of a cigarette of a first embodiment of the present invention.

A first preferred embodiment of a cigarette of the present invention is shown in FIG. 1. Cigarette 10 includes a generally cylindrical rod 15 of smokable material 20, such as tobacco cut filler, contained in a circumscribing wrapping material 25. The rod 15 hereinafter referred to as a "tobacco rod." The ends of the tobacco rod 15 are open to expose the smokable material. The tobacco rod is used by lighting one end thereof, and aerosol (e.g., smoke) is provided as a result of the combustion of the burning smokable material 20, which is lit at lighting end 26. As such, the tobacco rod burns back from the lit end thereof towards the opposite end (i.e., mouthend) thereof, and the smokable material of the tobacco rod is consumed by combustion during the smoking period.

The cigarette 10 also includes a filter element.30 positioned adjacent one end of the tobacco rod 15 such that the filter element and tobacco rod are axially aligned in an end-to-end relationship, preferably abutting one another. Filter element 30 has a generally cylindrical shape, and the diameter thereof is essentially equal to the diameter of the tobacco rod. The ends of the filter element are open to permit the passage of air and smoke therethrough.

Filter element 30 includes a filter material 32 (e.g., starch-based, polypropylene, or plasticized cellulose acetate tow) circumscribed by plug wrap 44. The filter material also can have the form of a gathered web (e.g., polypropylene web, polyester web or starch-based web), which is gathered using techniques such as are described in U.S. Pat. No. 4,870,809 to Pryor et al. If desired, the filter material can have at least one tubular capillary, passage or groove (not shown) extending longitudinally therethrough or partially therethrough. The plug wrap 44 is a paper which incorporates a carbonaceous material. The plug wrap circumscribes the total length of the filter element.

The filter element 30 is attached to the tobacco rod 15 by tipping material 45 which circumscribes both the entire length of the filter element and an adjacent region of the tobacco rod. The inner surface of the tipping material 45 is fixedly secured to the outer surface of the plug wrap 44 and the outer surface of the wrapping material 25 of the tobacco rod, using a suitable adhesive. A ventilated or air diluted smoking article is provided with an air dilution means, such as a series of perforations 50, each of which extend through the tipping material and plug wrap.

Figure 3:
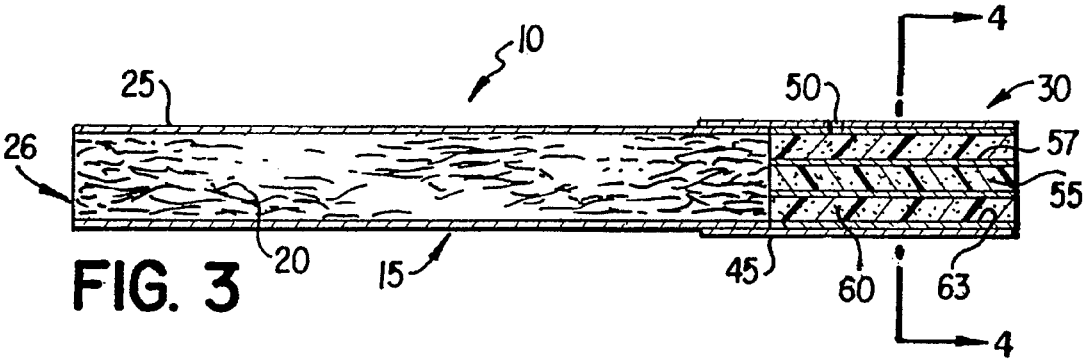
FIG. 3 is a longitudinal sectional view of a cigarette of a second embodiment of the present invention.

Referring to FIG. 3, a second embodiment of a cigarette 10 of the present invention is shown. The cigarette shown in FIG. 3 is generally similar to that cigarette described with reference to FIG. 1. However, the filter element 30 includes an inner core of filter material 55 (e.g., gathered paper, gathered polyolefin web, gathered polyester web or cellulose acetate tow) circumscribed by paper wrap 57. As such, the filter element is concentric in configuration. The paper wrap 57 is a paper which most preferably incorporates a carbonaceous material. The paper wrap 57 has the form of a tube which extends from one end of the filter element to the other. The paper wrap 57 is circumscribed by filter material 60, which is in turn circumscribed by plug wrap 63. The plug wrap 63 can be a conventional paper plug wrap material or a paper which incorporates a carbonaceous material. The filter material 60 which forms a sheath can be a gathered paper, cellulose acetate tow, gathered polyolefin (e.g., polyethylene or polypropylene) web or a gathered polyester web. Preferably, the core filter material is different in character or composition from the outer sheath material. The filter material also can be provided from a plasticized, non-wrapped cellulose acetate filter rod, such as is available from American Filtrona Corp. One example of a suitable filter element is one having a core region of a cellulose acetate tow item of 1.6 denier per filament/48000 total denier and a sheath region of a cellulose acetate tow item of 8.0 denier per filament/40000 total denier, wherein either or both of the filter materials can be circumscribed by a carbon-containing paper.

Figure 2:
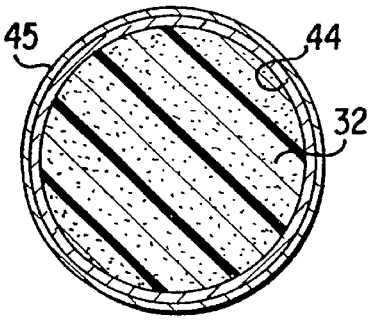
FIG. 2 is a radial sectional view of the cigarette of FIG. 1 taken along line 2—2.

Referring to FIG. 2, a cross-sectional view of the filter element described with reference to FIG. 1 is shown. As such, the plug wrap 44 appears as a black ring around the filter material 32.

Figure 4:
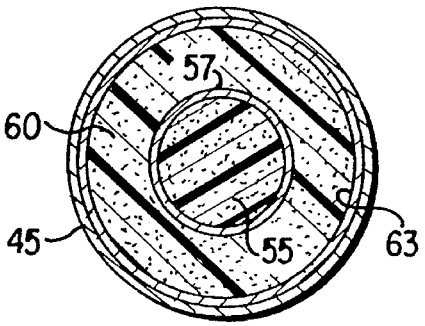
FIG. 4 is a radial sectional view of the cigarette of FIG. 3 taken along line 4—4.

Referring to FIG. 4, a cross-sectional view of the filter element described with reference to FIG. 3 is shown. As such, the plug wrap 63 which incorporates a carbonaceous material appears as a black ring around filter material 60, and paper wrap B7 appears as a black ring between filter materials 55 and 60.

Figure 5:
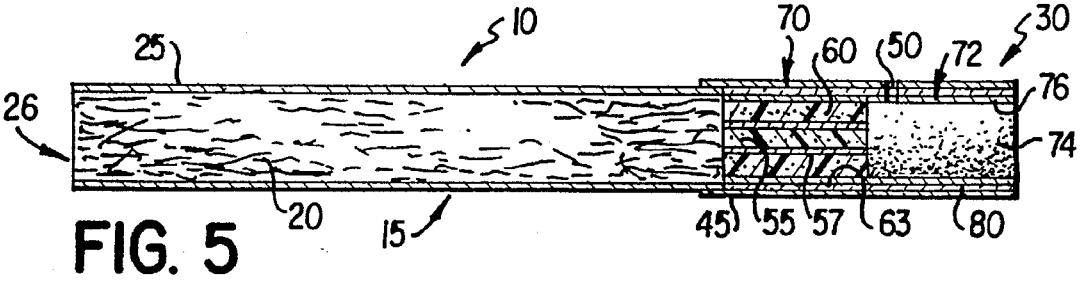
FIG. 5 is a longitudinal sectional view of a cigarette of a third embodiment of the present invention.

Referring to FIG. 5, another embodiment of a cigarette 10 of the present invention is shown. The cigarette shown in FIG. 5 is generally similar to that cigarette described with reference to FIG. 3. However, the filter element 30 includes two longitudinally positioned segments, a first segment 70 which is generally similar to that filter element described with reference to FIG. 3 (i.e., there are at least two tubes of paper containing carbonaceous material positioned within that segment), and a second segment 72 which includes a filter material 74 and a circumscribing plug wrap 76. The plug wrap 76 can be a conventional paper plug wrap material or a paper which incorporates a carbonaceous material. Alternatively, the first segment 70 can be generally similar to the filter element described with reference to FIG. 1. If desired, the first filter segment can have at least one tubular capillary or passage (not shown) extending longitudinally therethrough. Typically, such a passageway which extends through the first filter segment is provided from a narrow tube of cellulose acetate, polyethylene, polypropylene, or other plastic material. Typically, such a tube has an inner diameter of about 0.01 to about 0.06 inch, and usually about 0.03 to about 0.04 inch. If desired, the filter material of the first segment can contain flavoring agents and certain other additives, such as is described in U.S. patent application Ser. No. 945,042, filed Sep. 15, 1992. Typically, the first and second filter segments are different in length and/or composition of components. The two filter segments are longitudinally disposed relative to one another such that the first segment 70 is positioned adjacent one end of the tobacco rod, and the second segment 72 is positioned adjacent one end of the first segment and at the extreme mouthend of the cigarette. The two segments are maintained in an abutting end-to-end relationship by a circumscribing outer plug wrap material 80. Such filter elements can be provided using known techniques (e.g., using a Mulfi or plug tube combination machinery).

The smokable material employed in the manufacture of the tobacco rod can vary. For example, the smokable material of the cigarette can have the form of filter (e.g., tobacco cut filler). As used herein, the terms "filler" or "cut filler" are meant to include tobacco materials and other smokable materials which have a form suitable for use in the manufacture of tobacco rods for cigarettes. As such, filler can include smokable materials which are blended and are in a form ready for cigarette manufacture. The filler materials normally are employed in the form of strands or shreds as is common in conventional cigarette manufacture. For example, the cut filler material can be employed in the form of strands or shreds from sheet-like or "strip" materials which are cut into widths ranging from about 1/20 inch to about 1/60 inch, preferably from about 1/25 inch to about 1/35 inch. Generally, such strands or shreds have lengths which range from about 0.25 inch to about 3 inches.

Examples of suitable types of tobacco materials include flue-cured, Burley, Maryland or Oriental tobaccos, the rare or specialty tobaccos, and blends thereof. The tobacco material can be provided in the form of tobacco lamina; processed tobacco materials such as volume expanded or puffed tobacco, processed tobacco stems such as cut-rolled or cut puffed stems, reconstituted tobacco materials; or blends thereof. Certain reconstituted tobacco materials are described in U.S. Pat. Nos. 4,962,774 to Thomasson et al.; 4,987,906 to Young, et al.; 5,159,942 to Brinkley et al.; 5,099,864 to Young et al.; 5,143,097 to Sohn et al.; and 5,056,537 to Brown et al.; and in European Patent Application Nos. 419,733 and 535,834. Certain processed tobacco materials are described in U.S. Pat. Nos. 5,025,812 to Fagg, et al. and 5,065,775 to Fagg. Certain blends are described in U.S. Pat. Nos. 4,924,888 to Perfetti, et al.; 4,942,888 to Montoya, et al.; and 4,998,541 to Perfetti, et al. Preferably, the smokable material or blend of smokable materials consists essentially of tobacco filler material or consists only of tobacco filler material. Also of particular interest are smokable materials or blends of smokable materials, that when incorporated into tobacco rods which would provide mainstream smoke which would be perceived by the smoker to be harsh, woody, papery, bitter, sour, hot and irritating when smoked in cigarettes incorporating filter elements which are not filter elements of the present invention. For example, smokable filler consisting essentially of reconstituted tobacco material, consisting only of reconstituted tobacco material, incorporating relatively high levels of tobacco stems, or incorporating high levels of reconstituted and volume expanded tobacco materials can be employed in cigarettes employing the filter elements of the present invention. Exemplary cigarettes also are described in U.S. patent application Ser. No. 08/075,696, filed Jun. 11, 1993.

Smokable materials can be cased and top dressed as is conventionally performed during various stages of cigarette manufacture. As such, the smokable material, and particularly tobacco filler material, can include casing and/or top dressing components. For example, blend components such as flavoring agents and humectants, as well as other forms of tobacco (e.g., tobacco extracts), can be applied to the smokable material, as is commonly performed when cigarettes are manufactured. See, Leffingwell, et al., *Tobacco Flavoring For Smoking Products* (1972). Suitable flavoring agents and forms of tobacco include vanillin, tobacco extracts such as tobacco essences and tobacco aroma oils, cocoa, licorice, menthol, and the like. Flavor modifying agents such as levulinic can be applied to the smokable material (e.g., in amounts ranging from about 0.01 to about 2 percent, normally from about 0.1 to about 1 percent, preferably about 0.2 to about 0.6 percent, based on the dry weight of the smokable material). Such components conveniently are applied to the smokable material as casing and top dressing components. See, U.S. Pat. No. 4,830,028 to Lawson, et al.

Typically, the tobacco rod has a length which ranges from about 35 mm to about 85 mm, preferably about 40 to about 70 mm; and a circumference of about 17 mm to about 27 mm, preferably about 22.5 mm to about 25 mm. Short cigarette rods (i.e., having lengths from about 35 mm to about 50 mm) can be employed, particularly when smokable blends having a relatively high packing density are employed.

The packing densities of the blend of smokable materials contained within the wrapping materials can vary. Typical packing densities for tobacco rods of cigarettes of the present invention range from about 150 to about 300 $mg/cm^3$ . Normally, packing densities of the tobacco rods range from about 200 to about 280 $mg/cm^3$.

Exemplary tobacco rods having two layers of wrapping material circumscribing a charge of tobacco cut filler are described in U.S. Pat. No. 5,159,944 to Arzonico et al., in Examples 1 through 32 of U.S. patent application Ser. No. 07/661,747, filed Feb. 27, 1991, and in Examples 1 through 25 of U.S. patent application Ser. No. 07/759,266, filed Sep. 13, 1991, which are incorporated herein by reference.

Typically, the filter element has a length which ranges from about 15 mm to about 40 mm, preferably about 20 mm to about 35; and a circumference of about 17 mm to about 27 mm, preferably about 22 mm to about 25 mm. The filter element can have a wide range of filtration efficiencies.

The manner in which filter elements of the present invention are manufactured can vary. Filter tow (e.g., cellulose acetate or polypropylene tow) can be processed using a tow processing unit (e.g., an E-60 unit available from Arjay Equipment Corp., Inc.) and formed into a filter rod using a rod making unit (e.g., a KDF-2 rod making apparatus from Hauni-Werke Korber & Co., K.G.), wherein the paper plug wrap is provided using a paper plug wrap containing a carbonaceous material. A concentric filter can include an inner core of gathered paper or cellulose acetate tow circumscribed by a paper containing a carbonaceous material, which is in turn circumscribed by a sheath of cellulose acetate tow, which is in-turn circumscribed by a paper plug wrap. If desired the concentric filter can be provided from a filter material circumscribed by paper containing a carbonaceous material which is then inserted to fit snugly into the central passageway of a non-wrapped acetate plasticized cellulose acetate tube.

The filter elements can be manufactured using a rod making unit available as CU-10, CU-20 or CU-20S from Decoufle s.a.r.b. together with a KDF-2 rod making unit. As such, the carbon-containing paper which is used to provide the plug wrap of the filter can be embossed or patterned, typically so as to include a plurality of longitudinally extending serrations or corrugations. As such, there can be provided numerous air flow passageways between the tipping paper and the plug wrap. Typically, corrugations can be in the form of ridges spaced about 1 mm to about 2 mm, and often about 1.5 mm to about 1.7 mm apart and about 0.1 to about 1 mm, often about 0.7 mm to about 0.9 mm deep. When such a corrugated plug wrap is employed, the cigarette can be air diluted by perforating the tipping paper, but not perforating the plug wrap in order that the air which dilutes the smoke during draw experiences a tendency to pass through the air flow passageways between the tipping paper and plug wrap and into the mouth of the smoker. Representative concentric filters which can be modified so as to have the carbon-containing paper incorporated therein are described in European Patent Application No. 474,940.

The amount of carbonaceous material incorporated within a carbon-containing paper can vary. Typically, the amount of carbonaceous material within such paper is more than about 10, usually more than about 20, generally more than about 25, often more than about 30, and frequently, more than about 40 weight percent, based on the dry weight of the paper. Typically, the amount of carbonaceous material within such paper is less than about 65, often less than about 60 and frequently less than about 55 weight percent, based on the dry weight of the paper. Similar amounts of the other materials capable of absorbing and/or adsorbing gas phase components from cigarette smoke also can be incorporated into the paper in place of the carbonaceous material.

The amount of carbonaceous material within the filter segment containing the gathered paper containing that material typically ranges from about 20 to about 120 mg, often about 40 to about 110 mg, and frequently about 60 to about 100 mg. Similar amounts of the other materials capable of absorbing and/or adsorbing gas phase components from cigarette smoke also can be incorporated into the paper in place of the carbonaceous material.

Typically, the weight of the carbon-containing paper or similar paper within the filter segment incorporating that paper ranges from about 75 to about 250 mg, generally about 100 to about 225 mg and often about 125 to about 200 mg.

The carbonaceous material which is incorporated into the filter element can vary. Most preferred carbonaceous materials are highly activated. The degree of activation can vary, and typically is such so as to provide about 25 to about 125, more typically about 60 to about 70, weight percent pickup of carbon tetrachloride. Carbonaceous materials most useful herein have a high carbon content; consist primarily of carbon; and preferably have a carbon content above about 80 weight percent, and more preferably above about 90 weight percent. Preferred carbonaceous materials are provided by carbonizing or pyrolyzing bituminous coal, tobacco material, softwood pulp, hardwood pulp, coconut hulls, kapok fibers, cotton fibers, cotton liners, and the like. Examples of suitable carbonaceous materials are activated coconut hull based carbons available from Calgon Corp. as PCB, PCGB and GRC-11. Examples of suitable carbonaceous materials are coal based carbons available from Calgon Corp. as S-Sorb, BPL, CRC-11F, FCA and SGL. Examples of suitable carbonaceous materials are wood based carbons available from Westvaco as WV-B, SA-20 and BSA20. Other carbonaceous materials are available from Calgon Corp. as HMC, ASC/GR-1 and SC II. Another carbonaceous material includes Witco Carbon No. 637. Other carbonaceous materials are described in U.S. patent application Ser. No. 07/569,325, filed Aug. 17, 1990; U.S. Pat. Nos. 4,771,795 to White, et al. and 5,027,837 to Clearman, et al.; and European Patent Application Nos. 236,922; 419,733 and 419,981. Certain carbonaceous materials, which can be activated, can be impregnated with substances such as silver, copper, platinum, palladium, potassium bicarbonate, tobacco extracts, menthol, polyethyleneimine, manganese dioxide, chromate salts, eugenol, and 4-ketononanoic acid.

The size of the individual carbonaceous powder, particles or granules can vary, depending upon the desired design of the filter element. The individual powdered or fine grain carbonaceous particles typically have a diameter of about 10 μm to about 250 μm, often about 20 μm to about 100 μm, and frequently 30 μm to about 70 μm. Particularly preferred powdered or fine grain particles can be characterized as having an average diameter of about 40 μm, or such that 90 percent of the particles or fine grains pass through a 325 U.S. mesh screen. The materials which are incorporated into the paper in place of the carbonaceous material can have similar particle sizes.

The carbon-containing paper includes other materials. The paper includes at least one cellulosic material, can include at least one inorganic filler, and can include other additives or ingredients employed in the paper making industry. Exemplary cellulosic materials include flax fibers, hardwood pulp (preferably unbleached), softwood pulp (preferably unbleached), cotton fibers, tobacco parts (e.g., tobacco laminae and stem pieces), and the like. Exemplary inorganic filler materials include agglomerated calcium carbonate particles, calcium carbonate particles, calcium sulfate fibers, precipitated magnesium hydroxide gel, clay particles, and the like. Most preferably, the materials which make up the paper are incorporated into the paper during manufacture using the paper making process. Components such as sizing agents and moisture also can be incorporated into the carbon-containing paper. Typically, the amount of sizing agent incorporated into the paper is less than about 5 weight percent, and often about 0.1 to about 3 weight percent; and the moisture content of the paper ranges from about 5 to about 15 weight percent, and often about 8 to about 12 weight percent. Flavoring agents and other smoke modifying agents (e.g., tobacco extracts, heat treated tobacco extracts, spearmint, vanillin, anethole and menthol) also can be incorporated into the carbon-containing paper. Exemplary tobacco extracts are spray dried extracts and are described in U.S. Pat. No. 5,060,669 to White et al. A preferred carbon-containing paper consists essentially of softwood pulp and carbonaceous material. Certain carbon-containing papers are absent of tobacco material. Certain carbon-containing papers are absent of inorganic fillers (e.g., calcium carbonate particles), and are absent of thermoplastic fibers (e.g., polyethylene, polypropylene or polyester fibers).

The physical properties of the carbon containing paper or similar types of papers can vary. The thickness of the paper typically ranges from about 0.08 mm to about 0.2 mm, often about 0.13 mm to about 0.18 mm. The basis weight of the paper typically ranges from about 25 g/m$^2$ to about 60 g/m$^2$, often about 45 g/m$^2$ to about 55 g/m$^2$. The tensile strength of the paper preferably is at least about 800 g/in, typically ranges from about 1100 g/in to about 2300 g/in, although papers having greater tensile strengths can be employed. The porosity (i.e., inherent porosity) of the paper preferably is quite high, but typically ranges from about 50 to about 300 CORESTA units, often about 70 to about 200 CORESTA units. The paper can be electrostatically perforated to provide a relatively high net permeability. Typically, papers having exceedingly low porosities have a tendency to provide relatively low removal efficiencies of gas phase components of mainstream smoke.

Exemplary carbon-containing papers are available as P-144-17AC, P-144-30AC, P-144-50AC, P-144-50 HMC, P-144-50 SGL, P-144-BSHE, P-144-BAC, P-144-50-SA20, P-144-70-KCG, P-144-70SA20, P-2674-12-12, P-2674-13-17, P-2674-14-24, P-2674-11-3, P-2674-11-7, P-3122-6-8, P-3122-6-6, P-3122-6-5, P-3122-6-121, P-3001-72-1, P-144-BHC XCCW/KCB65, XCCW/KCG50, XCCW/KCG30, XCCW/KCG17, GPRCW/50KG, GPRCW/50SPEC, from Kimberly-Clark Corp. Other carbon-containing papers are described in European Patent Application Nos. 342,538 and 532,329, which is incorporated herein by reference. Other carbon-containing papers will be apparent to the skilled artisan. For example, carbon particles can be embedded in a paper substrate and employed as a wrapping material for a filter segment. If desired, papers containing granular molecular sieves rather than carbon particles can be employed. A representative paper is available from Kimberly-Clark Corp. and is designated as ABS-50. Such a paper includes about 50 weight parts softwood pulp and about 50 weight parts molecular sieve particles available as Abscent Molecular Sieve from Union Carbide Corp. If desired, conjugated polyunsaturated isoprenoids (e.g., betacarotene) can be incorporated into the paper (e.g., by spraying, printing, or the like). See, U.S. patent application Ser. No. 08/075,696, filed Jun, 11, 1993.

If desired, the filter materials which are used can have flavoring agents (e.g., menthol) incorporated therein.

Typically, the tipping material circumscribes the filter element and an adjacent region of the tobacco rod such that the tipping material extends about 3 mm to about 6 mm along the length of the tobacco rod. Typically, the tipping material is a conventional paper tipping material and is adhesively secured to the filter element and the adjacent region of the tobacco rod. The tipping material can have a permeability which can vary. For example, the tipping material can be essentially air impermeable, air permeable, or be treated (e.g., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

For air diluted or ventilated cigarettes of this invention, the amount of air dilution can vary. Often, the amount of air dilution for an air diluted cigarette is greater than about 10 percent, and frequently greater than about 25 percent. The upper limit of air dilution for a cigarette typically is less than about 75 percent, more frequently less than about 65 percent.

Cigarettes of the present invention exhibit a desirably high resistance to draw. For example, cigarettes of this invention exhibit a pressure drop of between about 50 and about 200 mm water pressure drop at 17.5 cc/sec. air flow. Typically, pressure drop values of cigarettes are measured using a Filtrona Filter Test Station (CTS Series) available from Filtrona Instruments and Automation Ltd. Cigarettes of this invention preferably exhibit resistance to draw values of about 70 to about 180, more preferably about 80 to about 50 mm water pressure drop at 17.5 cc/sec. air flow.

Cigarettes of the present invention generally provide FTC "tar" yields in the range from about 2 to about mg/cigarette, although other "tar" yields are possible. Typical FTC "tar" to FTC carbon monoxide ratios for such cigarettes are less than about 1.5, and sometimes are less than about 1.2. If desired, suitable catalytic compounds for the removal of carbon monoxide can be incorporated into the filter element. Cigarettes of the present invention exhibit desirable organoleptic properties. Cigarettes having carbonaceous materials within the filter element preferably exhibit a smooth smoking character, and provide less harsh and less bitter attributes than comparable cigarettes not having such a filter element. Preferred filter elements assist in reducing the gas phase components of cigarette smoke that have a propensity to provide a harsh, irritating, stingy, sour and bitter character to mainstream tobacco smoke. As such, cigarettes of the present invention are capable of providing the smoker with mainstream smoke which is smooth tasting, exhibits good strength and body, exhibits good tobacco smoke flavor, and yields an acceptable aftertaste. The filter elements of the present invention are capable of removing condensable gas phase components from mainstream tobacco smoke to a significant degree. Condensable gas phase components include organic compounds such as hydrogen cyanide, isoprene, 1,3-butadiene, and carbonyl compounds (e.g., acetone, formaldehyde, acrolein and acetaldehyde). Cigarettes of the present invention typically exhibit yields of certain mainstream condensable gas phase components which are less than 80 percent, and frequently are less than 75 percent, that of those yields of a cigarette of similar format and configuration but employing a filter segment not incorporating the carbonaceous material used according to the present invention.

Although not preferred, it is possible to incorporate filter elements of the present invention into those types of cigarettes described in U.S. Pat. Nos. 5,178,167 to Riggs et al.; 5,183,062 to Clearman et al.; 5,203,355 to Clearman et al.; 5,156,170 to Clearman et al.; 5,137,034 to Perfetti et al.; 5,076,292 to Sensabaugh, Jr., et al.; 5,065,776 to Lawson et al.; 5,067,499 to Banerjee et al.; 5,060,666 to Clearman et al.; 5,033,483 to Clearman et al.; 4,989,619 to Clearman et al.; 5,020,548 to Farrier et al.; 5,105,837 to Barnes; 4,714,082 to Banerjee et al.; 4,854,311 to Banerjee et al.; and 4,881,556 to Clearman et al.; and U.S. patent application Ser. Nos. 08/040,227; 07/856,239; 07/882,209; 07/947,002; 07/800,679; 08/018,637; 08/049,056; 08/043,886; and 07/947,021.

The following examples are provided in order to further illustrate the invention but should not be construed as limiting the scope thereof. Unless otherwise noted, all parts and percentages are by weight.

EXAMPLE 1

Cigarettes substantially as shown in FIG. 1 are provided as follows:

The cigarettes each have a length of about 83 mm and a circumference of about 24.4 mm. The tobacco rod has a length of about 56 mm, and the filter element has a length of about 27 mm. Each filter element includes a cellulose acetate tow (2.7 denier per filament/39000 total denier) plasticized using triacetin and circumscribed by a 0.98 inch width of carbon-containing paper available as XCCW/KCG-50 or P-144-KGG-50 from Kimberly-Clark Corp. Such a paper is made of about 50 parts carbon, abut 50 parts wood pulp. The filter element is made by wrapping the paper wrap around the length of the cylindrical segment of filter material.

The smokable material is an American blend of fluecured, Burley, Oriental, reconstituted and volume expanded tobaccos in cut filler form. The blend has been cased and top dressed. The paper wrapper of the tobacco rod is available as Ref. No. 456 from Miguel y Costas.

The filter element is attached to the tobacco rod using paper tipping material. The cigarette is not air diluted.

EXAMPLE 2

Cigarettes are provided essentially as described in Example 1; however, the cigarette is air diluted to a level of 25 percent air dilution by providing a ring of perforations in the filter element about 13 mm from the extreme mouthend of the cigarette.

EXAMPLE 3

Cigarettes are provided essentially as described in Example 2; however, the cigarettes are air diluted to a level of 50 percent air dilution.

EXAMPLE 4

Cigarettes are provided, essentially as described in Example 1. however, the cigarette has a length of about 98 mm, wherein the length of the tobacco rod is about 67 mm and the length of the filter element is 31 mm. The cellulose acetate tow item is 3.6 denier per filament/31000 total denier, and is plasticized using triacetin. The filter tow material is wrapped with a 0.91 inch width of carbon-containing paper plug wrap, as is described in Example 1. The paper wrapper of the tobacco rod is available as Ref. No. 453 from Ecusta Corp. The cigarette is not air diluted.

EXAMPLE 5

Cigarettes are provided essentially as described in Example 4; however, the cigarette is air diluted to a level of 25 percent air dilution by providing a ring of perforations in the filter element about 13 mm from the extreme mouthend of the cigarette.

EXAMPLE 6

Cigarettes are provided essentially as described in Example 5; however, the cigarettes are air diluted to a level of 50 percent air dilution.

EXAMPLE 7

A cigarette commercially available "Capri" from Brown & Williamson Tobacco Corp. is provided. The cigarette has a length of about 97 mm, wherein the length of the tobacco rod is about 70 mm and the length of the filter element is about 27 mm. The circumference of the cigarette is about 17 mm. The cellulose acetate tow of the filter element is carefully removed from the cigarette, wrapped with a 0.71 inch width of the carbon-containing paper described in Example 4, and the resulting filter element is inserted back into the cigarette.

EXAMPLE 8

Cigarettes are provided essentially as described in Example 7, but are air diluted by perforating the carbon-containing plug wrap in the air dilution region of the cigarette. The cigarettes are air diluted to air dilution levels of 25 percent and 50 percent.

EXAMPLE 9

A cigarette commercially available as "Merit Ultima" from Philip Morris Inc. is provided. The cigarette has a length of about 99 mm, wherein the length of the tobacco rod is about 68 mm and the length of the filter element is about 31 mm. The circumference of the cigarette is about 24.4 mm. The filter element has two longitudinally positioned segments, and one of those filter segments is concentric. The mouthend filter segment has a length of 7 mm, and the concentric segment has a length of 20 mm. The filter element is removed from the cigarette, as described in Example 7. The inner filter portion or core portion of the concentric segment is removed from the sheath portion, and the outer paper wrap of the core segment is removed and replaced with a 0.75 inch width of the carbon-containing paper described in Example 4. The core portion so provided is inserted into the sheath portion, and the cigarette is reassembled. The cigarette maintains its air dilution level of about 60 percent air dilution.

EXAMPLE 10

Cigarettes are provided essentially as described in Example 9; however, the air dilution perforations in the tipping paper are covered with adhesive tape to provide an essentially non-air diluted cigarette.

EXAMPLE 11

Cigarettes are provided essentially as described in Example 1; however, the carbon-containing paper used as the plug wrap is replaced by a paper containing about 50 parts softwood pulp and about 50 parts molecular sieve granules, which paper is available as ABS-50 from Kimberly-Clark Corp.

EXAMPLE 12

Cigarettes are provided essentially as described in Example 9; however, the carbon-containing paper used as the wrap of the core filter segment is replaced by the paper available as ABS-50 from Kimberly-Clark Corp.

As described for the first, second and third embodiments of FIGS. 1–5, incorporation of carbon in the filter of filter cigarettes has been previously shown to be effective in removing or reducing vapor phase compounds in cigarette smoke, by specific adsorption on its active sites. Ventilation on the other hand, results in overall reduction of the gas phase components by diluting the whole cigarette smoke with air. Thus, a 50% ventilation results in a 50 % average reduction of all gas phase compounds. A combination of carbon filter and high ventilation results in tremendous reduction in the gas phase of cigarette smoke, not only because of the additive effect, but also because air dilution increases the removal efficiency of carbon filter by increasing the residence time of the smoke in the filter. However, filters that combine the two features are complex in design and require several steps in manufacturing. The filter elements disclosed in the fourth, fifth, sixth and seventh embodiments of FIGS. 6–10 achieve this objective while keeping the configuration simple, and therefore are relatively easy to manufacture.

Figure 6:
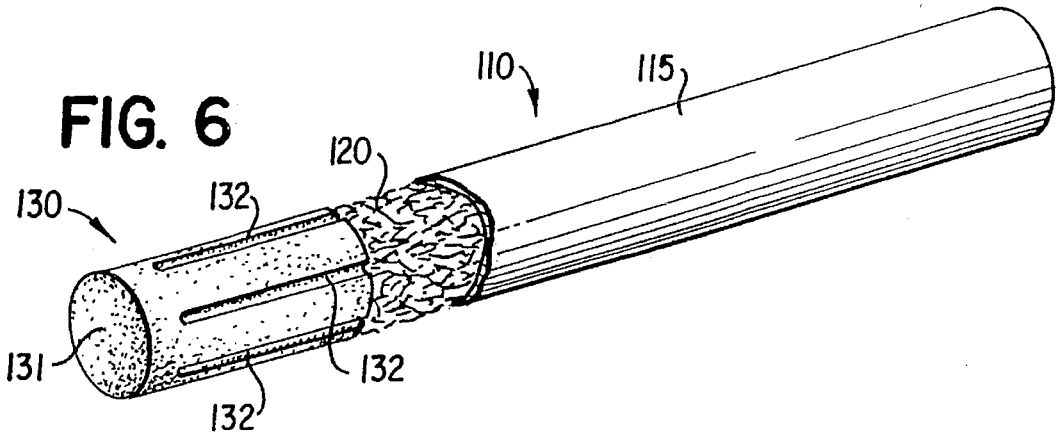
FIG. 6 is a perspective view in partial fragmented section of a cigarette of a fourth embodiment of the present invention.

FIG. 6 shows a fourth embodiment of a cigarette 110 having a filter element 130 of cellulose acetate tow 131 with grooves 132 disposed around the periphery thereof. The grooves 132 extend from the end of the filter element 130 that abuts the rod 115 of smokable material 120, substantially (but not entirely) along the length of the filter element 130.

Figure 7:
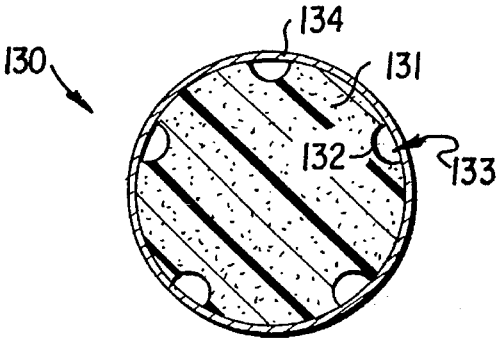
FIG. 7 is a radial cross-sectional view of a cigarette filter of the fourth embodiment of the invention.
Figure 8:
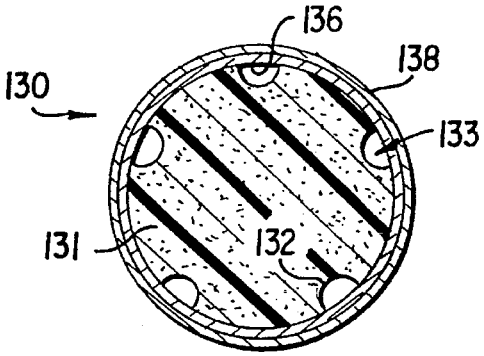
FIG. 8 is a radial cross-sectional view of a cigarette filter of a fifth embodiment of the invention.
Figure 9:
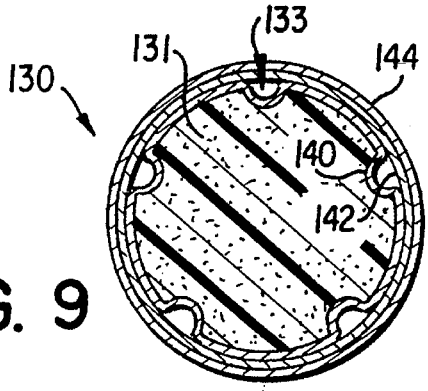
FIG. 9 is a radial cross-sectional view of a cigarette filter of a sixth embodiment of the invention.
Figure 10:
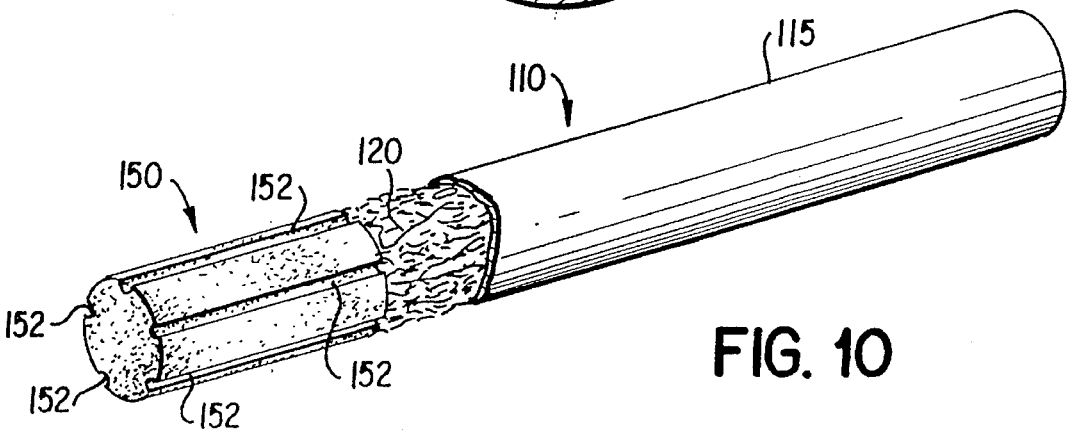
FIG. 10 is a perspective view in partial fragmented section of a cigarette of a seventh embodiment of the invention.

FIGS. 7–9 show various cross sections taken through filter element 130. FIG. 7 illustrates a single plug wrap 134 of a carbon-containing paper. A channel 133 is formed by grooves 132 and plug wrap 134 and directs cigarette smoke along the outer periphery of the filter element 130 and then back through the porous cellulose acetate tow which comprises the filter element 130. FIG. 8 is an embodiment in which a carbon-containing paper wrap 136 is provided, covered by a non-carbon-containing plug wrap 138. FIG. 9 is a further embodiment in which the smoke channel 133 is provided with a carbon-containing paper on all sides of the channel. Specifically, an inner layer 140 of carbon-containing paper is wrapped about filter element 130 with the paper contoured to fit within grooves 132. A second, outer layer 142 of carbon-containing paper is wrapped about filter element 130, overwrapping inner layer 140. However, the outer layer 142 is not contoured to fit within grooves 132. A layer 144 of plug wrap is then wrapped about outer layer 142. FIG. 10 shows a seventh embodiment similar to the embodiment of FIG. 6, but with the grooves 152 running the entire length of filter element 150. In such an embodiment, the smoke does not reenter the cellulose acetate tow, but exits the mouthpiece end of the filter element 150. Air dilution in each of the embodiments of FIGS. 6–10 can be provided by providing a perforation in each channel, similar to that shown in FIGS. 1–5.

The materials comprising the embodiments shown in FIGS. 6–10 are similar to those in the embodiments of FIGS. 1–5, with the differences noted below.

The function and operation of the filter embodiments of FIGS. 6–9 are as follows with the operation of the embodiment of FIG. 10 being similar: The filter 130 comprises a high efficiency cellulose acetate tow, formed into a rod with a high level of plasticizer, such as triacetin. The type of tow and type/level of plasticizer are adjusted such that the tow is almost impervious to cigarette smoke. The imperviousness of the filter 130 can also be achieved by a variety of other means, such as steam-bonding the cellulose acetate fiber. However, in some applications, a filter rod with lower efficiency may be desired. The surface of the filter rod is equipped with grooves 132 or other raised patterns. The depth, shape and number of grooves 132 are adjusted to achieve a differential pressure drop across the channels such that the majority of the smoke preferentially flows through the channel 133 instead of through the tow. In some cases, grooves or a pattern (not shown) may cover the entire length of the filter (FIG. 10), whereas in others, the grooves may cover only a partial length of the filter plug (FIG. 6). The rod is overwrapped with a paper having a low porosity and heavily filled with adsorbent like activated carbon. The activated carbon paper encloses the grooves 132, thereby forming longitudinal channels 133, and provides capillary pathways that carry the smoke from the tobacco end to the mouthend of the filter. Passage of the smoke through the capillary pathways creates a pressure drop without any significant filtration. The number and depth/shape of the channels determine the pressure drop. The particular configuration of the filter, forces the majority of the smoke to flow parallel to the surface of the carbon and in its close proximity, such that the lighter vapor phase molecules, which have a larger mean-free pathway than the heavier aerosol particles, are forced to react with the carbon surface, resulting into its adsorption on the active sites. For incorporation in the paper matrix, particle size of the carbon or other adsorbent is selected such that the maximum number of active sites are exposed on the surface. The channels 133 can be designed for maximum adsorption of the gas phase molecules without having any significant impact on the tar phase containing larger and heavier molecules. In cases-where an embossed pattern covers the entire length of the filter, a low-efficiency cellulose acetate filter with carbon paper as plug wrap may serve as a mouthend cap.

Examples of the embodiments of FIGS. 6–9 were prepared.

Filter rods were made with 1.6/48,000 dpf cellulose acetate tow and 9% triacetin as plasticizer. Five grooves 132, equally spaced around the circumference were made with an electronic soldering iron on a 31 mm segment of the filter. The grooves were 1 mm deep and 26 mm in length leaving 5 mm length without grooves. The filter was overwrapped with a paper containing 50% activated carbon. Tow was removed from a Camel Lt. 100 cigarette and the experimental filter was inserted into the cavity. The resulting cigarette was air-diluted to 50% by making a row of perforations with a 32 G needle at 20 mm from the mouthend. The air diluted cigarette had a pressure drop of 95 mm of water. Compared to control the cigarette was smoother with less harshness and the aerosol delivery was 10 mg when smoked under FTC conditions. These examples are shown as Examples 13 and 14 in the following table:

| | EXAMPLE 13 | EXAMPLE 14 |
|---|---|---|
| FILTER DE-SCRIPTION | ONE-PIECE | TWO PIECE |
| LENGTH | 31 mm | 31 mm |
| CIRCUM-FERENCE | 24.43 mm | 24.43 mm |
| PLUG WRAP | C-PAPER<br>SLIT WIDTH 26.5 mm<br>CORE SIZE 3" I.D.<br>POROSITY 67.5 CORESTA<br>CALIPER .1438 inch<br>BASIS WT. 65 g/m$^2$ | C-PAPER<br>SLIT WIDTH 26.5 mm<br>CORE SIZE 3" I.D.<br>POROSITY 6.75 CORESTA<br>CALIPER .1438 inch<br>BASIS WT. 65 g/m$^2$ |
| GROOVED SEGMENT | 24 mm | 24 mm |
| NO. OF GROOVES | 6 | 6 |
| DEPTH OF GROOVES | VARIES WITH GROOVE CONFIGURATION | VARIES WITH GROOVE CONFIGURATION |
| UN-GROOVED SEG. | 7 mm | 7 mm |
| PRESSURE DROP, WHOLE FILTER | 60–75 mm (WATER) | 60–75 mm (WATER) |
| PRESSURE DROP, GROOVES | 40–55 mm (WATER) | 40–55 mm (WATER) |
| PRESSURE DROP, END CAP | 5–20 mm (WATER) | 5–20 mm (WATER) |

Figure 11:
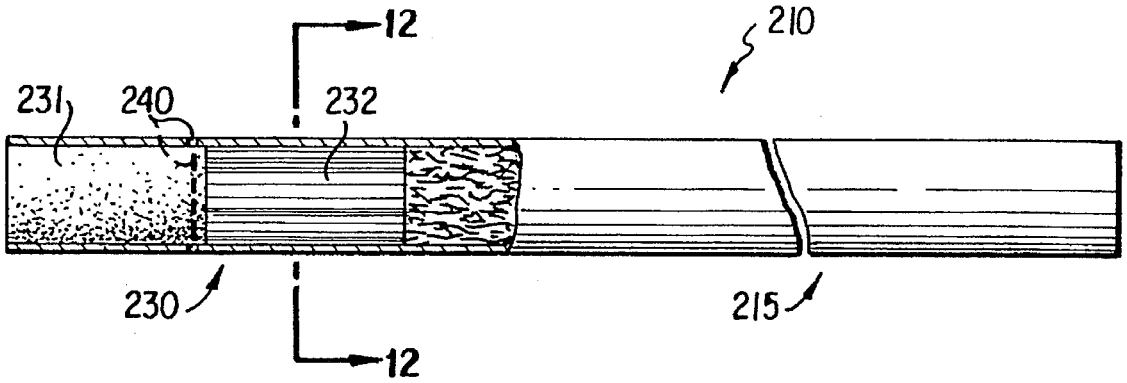
FIG. 11 is a partial fragmented sectional view of a cigarette of an eighth embodiment of the invention.
Figure 12:
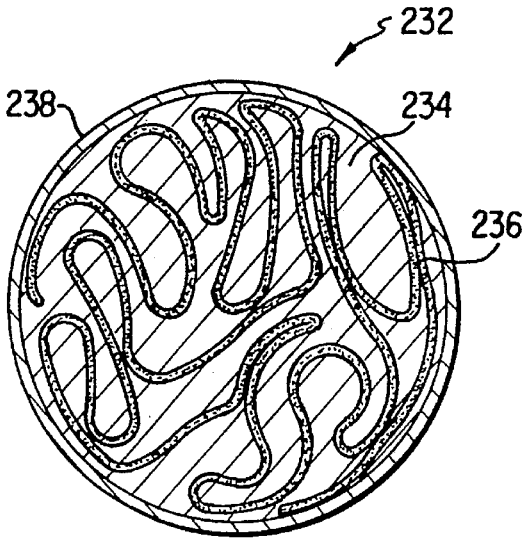
FIG. 12 is a sectional view of a cigarette filter of the eighth embodiment, taken along line 12—12. of FIG. 11.

An eighth embodiment of a filter having essentially randomly arranged flow channels formed by the carbon-containing paper and filled with a non-carbon-containing filter material such as cellulose acetate tow is shown in FIGS. 11–12. Therein, a cigarette 210 having a two-part filter 230 attached to a smokable rod 215 is illustrated. A mouthpiece 231 is attached by tipping material to a so-called "carbon ripple filter" (CR) segment 232. Carbon ripple filter segment 232 is so named because of the somewhat random, rippled appearance of the filter as shown in cross-section in FIG. 12. Filter segment 232 is formed by the simultaneous gathering into a cylindrical segment of a non-carbon-containing web 234 of cellulose acetate, polypropylene or polyester with a carbon-containing paper 236, as in an apparatus described in U.S. Pat. No. 4,807,809 to Pryor et al. Plug wrap 238 overwraps the gathered materials 234, 236. Ventilation holes 240 are provided circumferentially around the periphery of the mouthpiece 231, as shown in FIG. 11. The dimensions of the smokable rod 215 are similar to those described in the prior embodiments. The filter segments can be typically 12 mm for the carbon-containing segment 232 and 15 mm for the mouthpiece 231. The carbon containing paper 236 is typically 50% carbon in the form of activated coconut carbon available as PCB ground carbon having an average particle size of 40 microns, available from Calgon Carbon Corporation, Pittsburgh, Pennsylvania. Alternatively, the non-carbon- containing material may be tacked to the carbon-containing paper by applying a glue or adhesive or by bringing the web into contact with the carbon-containing paper while the web is still tacky from manufacture. Although not shown, it is contemplated that the mouthpiece 231 can be eliminated and only a carbon-containing segment of suitable length be provided having ventilation holes therein, as necessary.

In operation, this embodiment is similar to the filter described in U.S. Ser. No. 898,111, filed Jun. 12, 1992. That filter has channels that allow tar particles to pass through the filter with little or no interaction with the carbon paper) thus, resulting in little or no carbon off-taste. However, gas phase particles, due to their rapid diffusion, contact the side walls of the channels, interact with carbon and are adsorbed. Due to the channels in the aforementioned filter, there is no pressure drop associated with this portion of the filter. In the eighth embodiment, cellulose acetate, polypropylene web, polyester web, or some other appropriate material is gathered with the carbon paper resulting in a filter with the channels filled with a tar filtering media. This allows for pressure drop to be added to a filter segment with little or no taste impact to the filter. Since the regions of lowest pressure drop will still be through the tow or other non-carbon filter material (as opposed to through the edge of the carbon paper) tar will still pass into the channels, but will be filtered. Using the appropriate pressure drop (which can be varied, as appropriate) in a filter according to this embodiment allows it to be combined with a low pressure drop mouth end segment made of appropriate material which can result in a clean end appearance. Filters according to this embodiment having differing pressure drops can also be combined with regular cellulose acetate to aid in phenol removal and/or tar reduction. Typically, the pressure drop is in the range of 30–90 psig, and preferably from 50–75 psig.

Typical carbon ripple relative web sizes are contemplated as follows:

| Carbon Paper Web (inches) | Melt Blown Polypropylene Web (inches) | Polyester Web (inches) |
|---|---|---|
| 4.25 | 5.0 | |
| 4.25 | 7.0 | |
| 4.25 | | 5.0 |
| 4.25 | | 7.0 |
| 4.25 | | 4.25 |

EXAMPLE 15

A cigarette in accordance with the present embodiment is made having a smokable rod of flue cured tobacco and a filter having a 12 mm carbon-containing segment of gathered 4.25 inch carbon paper web and a 5.0 inch polyester web with a 15 mm mouthpiece made of polypropylene sheet. Air dilution holes were arranged around the periphery of the mouthpiece segment at a location 13 mm from the end of the mouthpiece. Such cigarettes have a tar yield of 10 mg. but have significantly reduced condensable vapor phase smoke components as compared to a 10 mg. tar product with a standard cellulose acetate filter.

Although certain presently preferred embodiments of the invention have been specifically illustrated and described herein, it will be appreciated by those skilled in the art to which the invention pertains that many modifications and variations of the present invention are possible in light of the above teachings without departing from the spirit and scope of the invention. Accordingly, it is intended that the invention be limited only to the extent required by the appended claims and the applicable rules of law.

What is claimed is:

1. A cigarette having a charge of smokable material including tobacco cut filler wrapped in a circumscribing wrapping material to form a smokable rod; the cigarette comprising a filter element positioned adjacent one end of the smokable rod; the filter element including filter material having a plurality of longitudinal grooves therein and circumscribed by a carbon-containing paper material.

2. The cigarette of claim 1 wherein the paper includes more than about 20 weight percent carbonaceous material, based on the dry weight of the paper.

3. The cigarette of claim 1 wherein the paper includes more than about 30 weight percent carbonaceous material, based on the dry weight of the paper.

4. The cigarette of claim 1 wherein the carbonaceous material within the filter element is an amount of about 25 to about 75 mg.

5. The cigarette of claim 1, wherein the paper consists essentially of wood pulp and carbonaceous material.

6. The cigarette of claim 1, wherein the carbon-containing paper material is contoured so as to fit within said grooves.

7. The cigarette of claim 6, wherein a layer of carbon-containing paper is wrapped over the contoured paper material so as to form a longitudinal channel.

8. The cigarette of claim 1, wherein a noncarbon-containing plug wrap layer is wrapped over said carbon-containing paper material.

9. The cigarette of claim 7, wherein a noncarbon-containing plug wrap layer is wrapped over said second layer.

10. A cigarette having a charge of smokable material including tobacco cut filler wrapped in a circumscribing wrapping material to form a smokable rod; the cigarette comprising a filter element positioned adjacent one end of the smokable rod; the filter element including a carbon-containing paper material randomly gathered with a web of filter material different from said carbon-containing paper material and from said smokable material, thereby forming randomly oriented flow paths having carbon-containing paper therein.

11. The cigarette according to claim 10, wherein the carbon-containing paper includes approximately 50 weight percent carbonaceous material, based on the dry weight of the paper.

12. The cigarette according to claim 10, wherein the web of filter material is polypropylene.

13. The cigarette according to claim 10, wherein the web of filter material is polyester.

14. The cigarette according to claim 10, wherein the filter element includes a non-carbon-containing mouthpiece segment and a carbon-containing segment.

15. The cigarette according to claim 14, wherein the mouthpiece segment includes a plurality of ventilation holes arranged circumferentially around the outer periphery of the mouthpiece segment.

16. A cigarette having a charge of smokable material including tobacco cut filler wrapped in a circumscribing wrapping material to form a smokable rod; the cigarette comprising a filter element positioned adjacent one end of the smokable rod; the filter element including filter material circumscribed by a molecular sieve-containing paper material.

17. A cigarette having a charge of smokable material including tobacco cut filler wrapped in a circumscribing wrapping material to form a smokable rod; the cigarette comprising a filter element positioned adjacent one end of the smokable rod; the filter element including filter material having a plurality of longitudinal grooves therein and circumscribed by a molecular sieve-containing paper material.

18. A cigarette having a charge of smokable material including tobacco cut filler wrapped in a circumscribing wrapping material to form a smokable rod; the cigarette comprising a filter element positioned adjacent one end of the smokable rod, said filter element having a circumferential periphery; the filter element including filter material having a plurality of longitudinal grooves therein and located around said periphery and circumscribed by a carbon-containing paper material.

19. A cigarette having a charge of smokable material including tobacco cut filler wrapped in a circumscribing wrapping material to form a smokable rod; the cigarette comprising a filter element positioned adjacent one end of the smokable rod and having a cross-section; the filter element including a carbon-containing paper material randomly gathered with a web of filter material different from said carbon-containing paper material and from said smokable material, thereby forming randomly oriented flow paths disposed throughout the cross-section of the filter element and having carbon-containing paper therein.

* * * * *